US005827039A

United States Patent [19]

Gämmerler

[11] Patent Number: 5,827,039

[45] Date of Patent: Oct. 27, 1998

[54] APPARATUS FOR HANDLING A STACK OF SHEET-LIKE PRODUCTS

[76] Inventor: Hagen Gämmerler, Ichoring 44, D-82057 Icking, Germany

[21] Appl. No.: 776,820

[22] PCT Filed: Aug. 3, 1995

[86] PCT No.: PCT/EP95/03099

§ 371 Date: Jan. 31, 1997

§ 102(e) Date: Jan. 31, 1997

[87] PCT Pub. No.: WO96/04194

PCT Pub. Date: Feb. 15, 1996

[30] Foreign Application Priority Data

Aug. 4, 1994 [DE] Germany ..... 44 27 703.2

[51] Int. Cl.[6] ..... B65G 47/90

[52] U.S. Cl. ..... 414/744.6; 414/744.2; 414/623; 414/790.2

[58] Field of Search ..... 414/621, 623 CR, 414/659, 660, 751, 589, 590, 790.2, 796.3, 744.2, 744.4, 744.6; 198/346.2

[56] References Cited

U.S. PATENT DOCUMENTS

| | | | |
|---|---|---|---|
| 4,383,788 | 5/1983 | Sylvander . | |
| 4,421,221 | 12/1983 | Pessina et al. | 198/372 |
| 4,471,955 | 9/1984 | Bradley et al. | 270/58 |
| 4,502,828 | 3/1985 | Stobb | 414/226 |
| 4,545,715 | 10/1985 | Seefeldt | 414/790.2 |
| 4,588,070 | 5/1986 | Smith | 198/468.3 |
| 4,738,574 | 4/1988 | Emmert | 269/57 |
| 4,804,306 | 2/1989 | Schulte | 414/796.2 |
| 4,842,573 | 6/1989 | Peter et al. | 493/412 |
| 4,992,016 | 2/1991 | Ferloni | 414/709.2 |
| 5,042,862 | 8/1991 | Tübke | 294/86.4 |
| 5,354,170 | 10/1994 | Schweingruber et al. | 414/790.2 |

FOREIGN PATENT DOCUMENTS

| | | | |
|---|---|---|---|
| 50339 | 4/1982 | European Pat. Off. | 414/790.2 |
| 0 057 894 | 8/1982 | European Pat. Off. . | |
| 0 068 462 | 1/1983 | European Pat. Off. . | |
| 0 292 770 | 11/1988 | European Pat. Off. . | |
| 40 32 854 A1 | 4/1991 | Germany . | |
| 4203118 | 5/1993 | Germany | 414/790.2 |
| 93170 | 4/1987 | Japan | 414/790.2 |
| WO 94/12351 | 6/1994 | WIPO . | |

*Primary Examiner*—David A. Buci
*Assistant Examiner*—Douglas Hess
*Attorney, Agent, or Firm*—Fitch, Even, Tabin & Flannery

[57] ABSTRACT

An apparatus for handling stacks of sheet-like products is provided and includes a rotary table on which gripper devices are mounted for linear shifting. The table has a central axis of rotation about which it is rotatable and includes linear carriage guides on which carriages of the devices can be shifted linearly. A linear drive propels the carriages and devices thereon in a linear direction along the guides between waiting and working positions. Each gripper device includes upper and lower gripper units with the lower gripper unit sliding beneath and out from under the product stack as the carriages are driven between the waiting and working positions depending on whether the units are to support a stack to be moved or are dropping it off at a station for further processing and/or transfer.

12 Claims, 5 Drawing Sheets

APPARATUS FOR HANDLING A STACK OF SHEET-LIKE PRODUCTS

Figure 1:
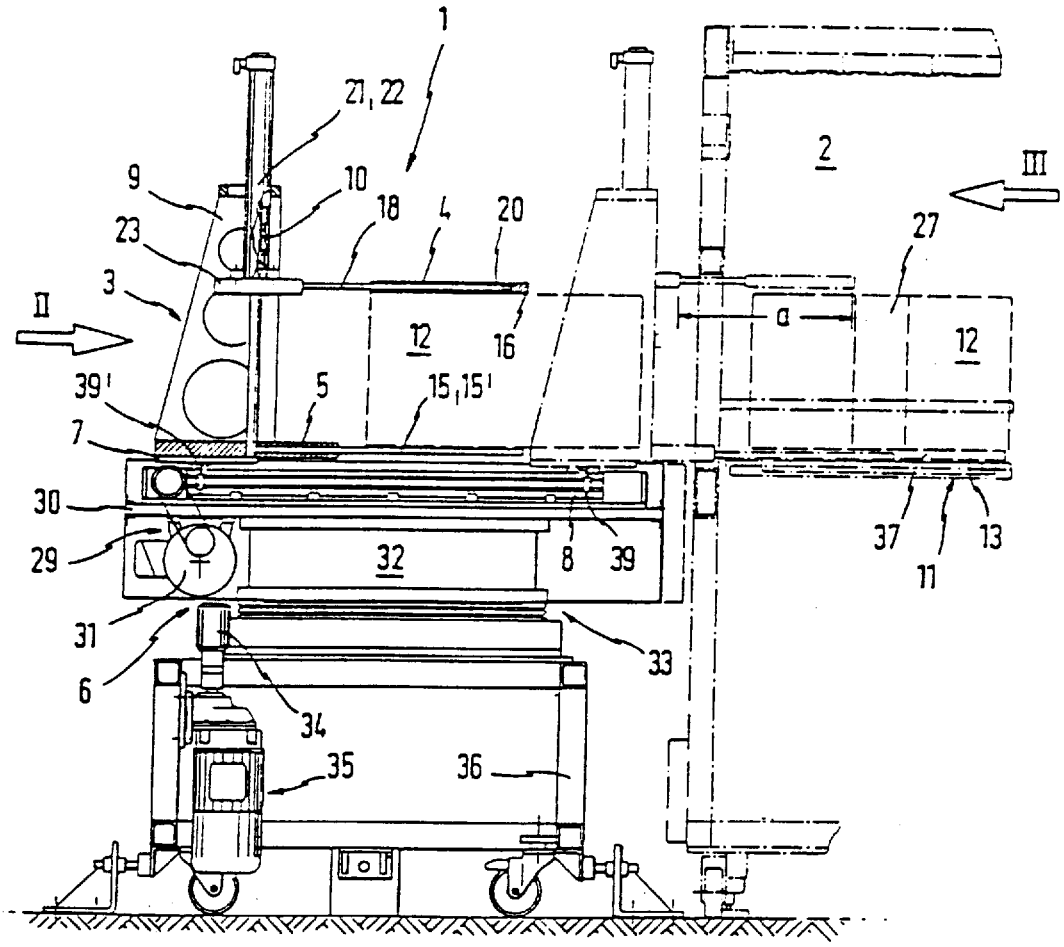

The invention relates to an apparatus for handling a stack of sheet-like products.

Such stacks of sheet-like products, for example when these are folded printed products, are normally pushed from the stacking table by an ejector onto a conveyor device consisting of rollers or a transport belt which conveys the stack on further. A treatment of this kind, namely the ejection and the subsequent transportation on a rolling belt can, with certain stacks, lead to a shifting of the product in the stack, so that the danger exists that the stack falls apart.

A rotatable table for stackers in book-binding workshops is known from EP-A-O 057 894 and has a diametral slot in which a slider is movably arranged. A stack is formed on the rotatable table in the interior of four vertical guides and is ejected sideways by the slider after the lateral displacement of the guides.

A transfer device for a stack of folded endless paper is known from WO-A-94 12 351. This apparatus has a transfer fork which can be moved forward and back and is also pivotable about an axis. For the handling of a paper stack, the transfer fork, whose upper and lower fork elements are rigidly arranged relative to one another, is moved into a transfer unit and is subsequently pivoted about a horizontal axis though 180°. Following this, a slider is actuated which ejects the paper stack from the transfer fork and transfers it to a further handling unit.

The invention is based on the object of improving an apparatus of the named kind in such a way that the stack which arises can be reliably removed without delay in accordance with the high working speed and conveyed to a further processing station. The solution of this object is achieved by an apparatus for handling a stack of sheet-like products comprising:

- a rotary table on which at least two gripper devices are arranged which have an upper and lower gripper unit, wherein,
- each gripper device can be moved forwardly and backwardly on a carriage in a horizontal guide of the rotary table.

Through the apparatus of this invention a reliable grasping and also removal of the stack from the stacking station and its conveyance to the further processing station is ensured with a high working speed of the production line without the stack falling apart.

Advantageous measures are set forth in the subordinate claims which in each case recite a favourable further development of the apparatus.

The gripper device with the specially designed upper and lower gripper units represents an important inventive measure. The stack experiences excellent stabilisation through the special features of the upper gripper unit which presses a channel or several waves into the stack in the removal direction of the gripper, with the stack adopting this one or multiple channel-like structure over its entire stack height as a consequence of the fork-like design of the lower gripper unit, so that no additional measures are required to fix the individually stacked printed products or to hold them in position.

Figure 2:
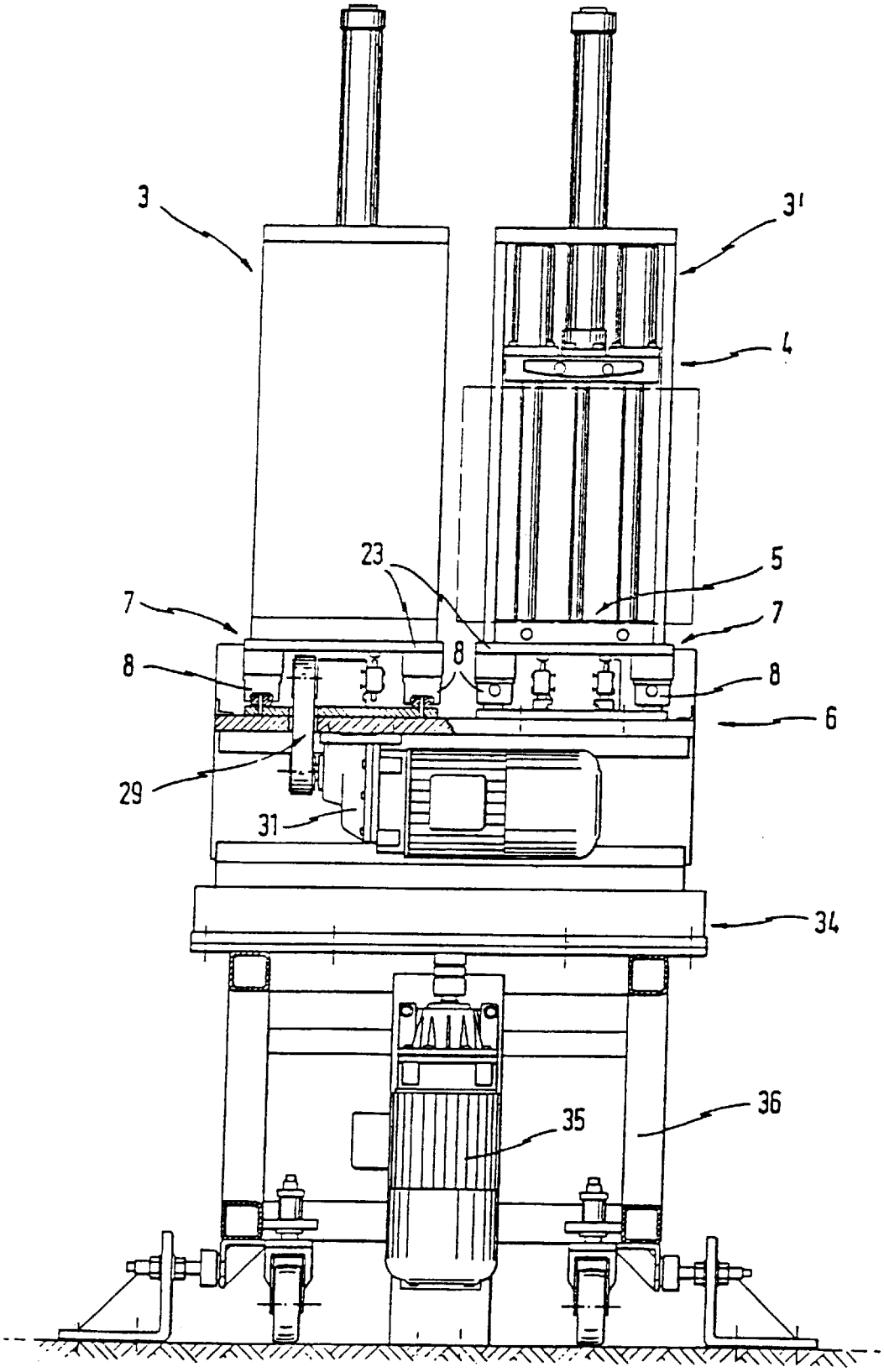
Figure 3:
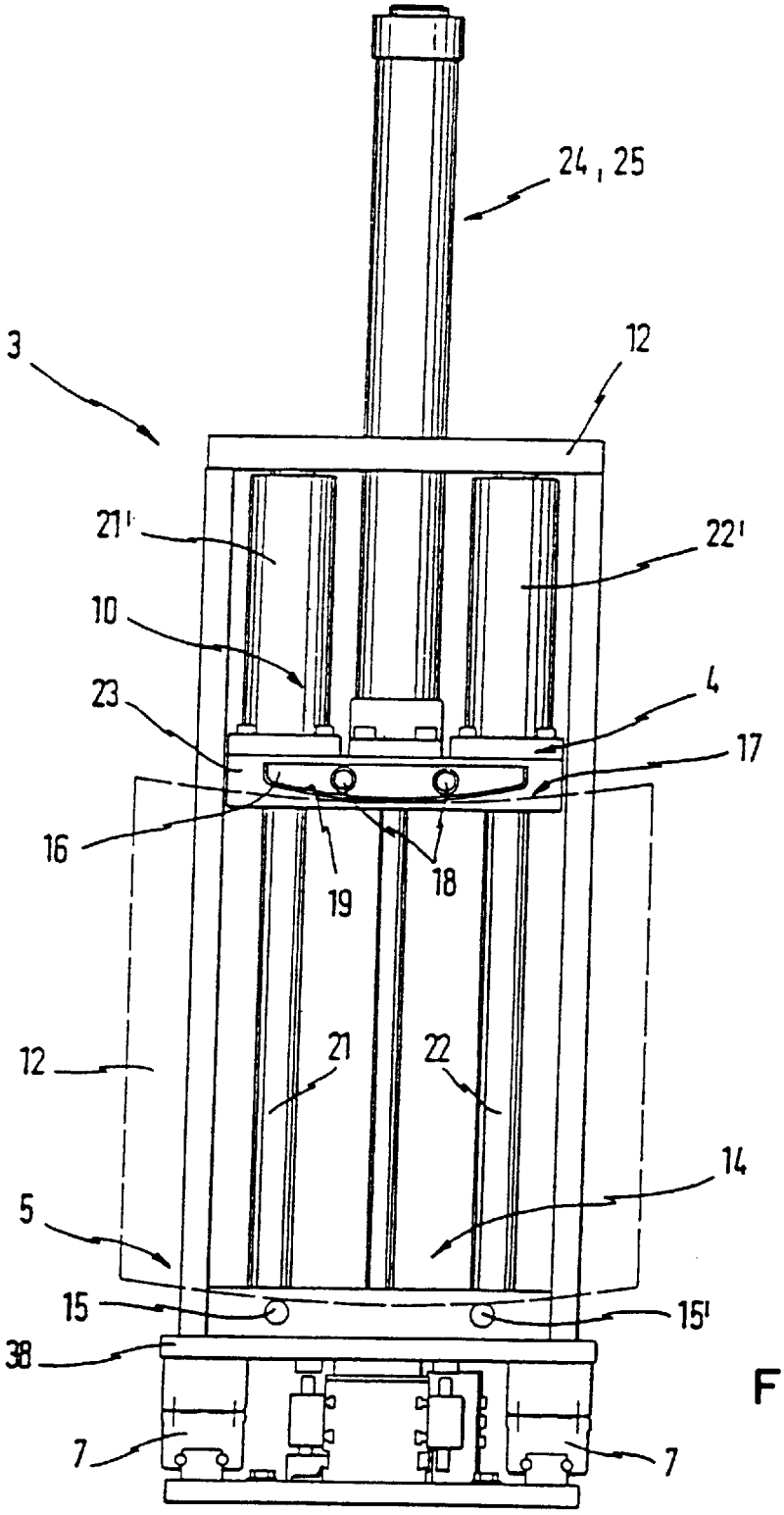
Figure 4C:
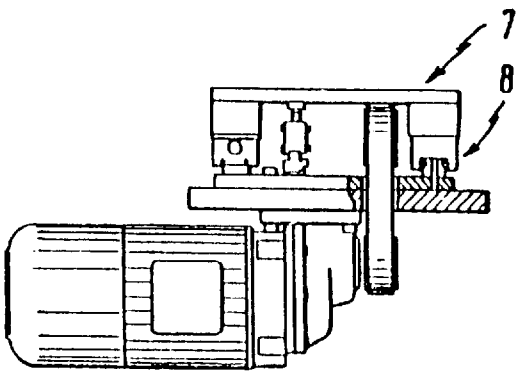
Figure 4A:
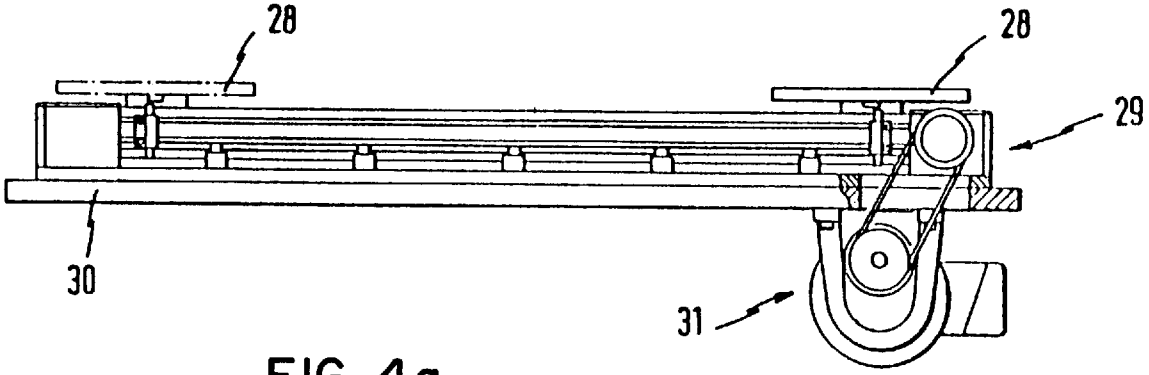
Figure 4B:
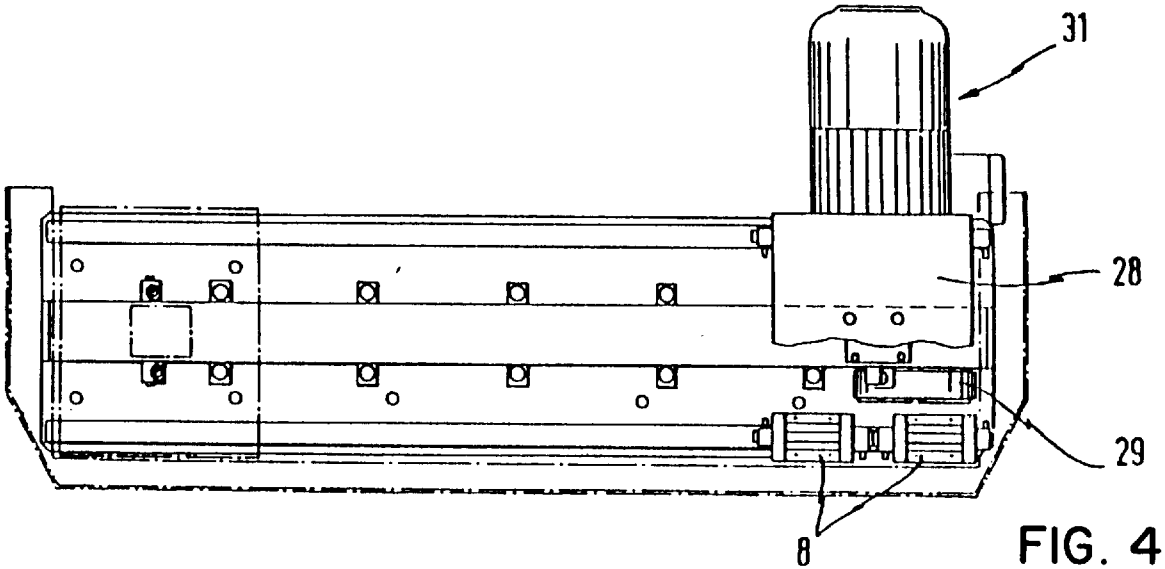
Figure 5:
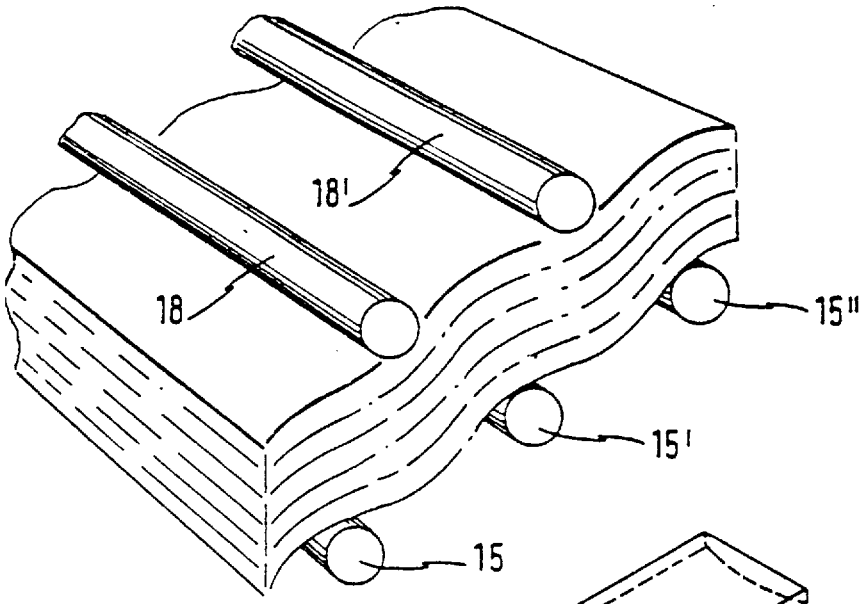
Figure 6:
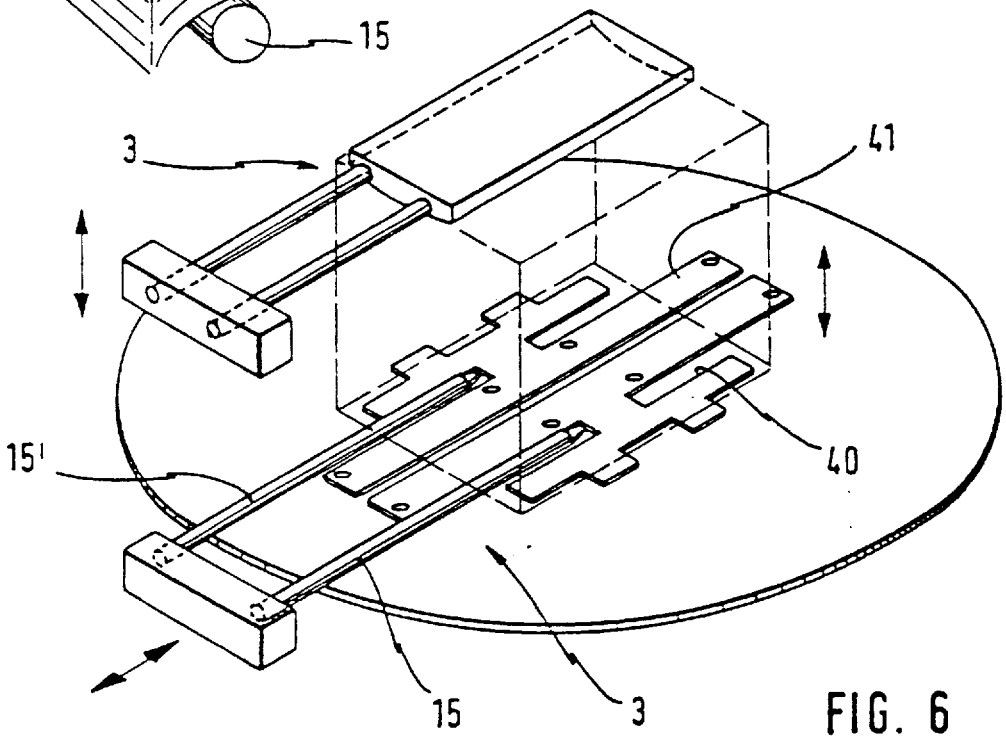
Figure 7:
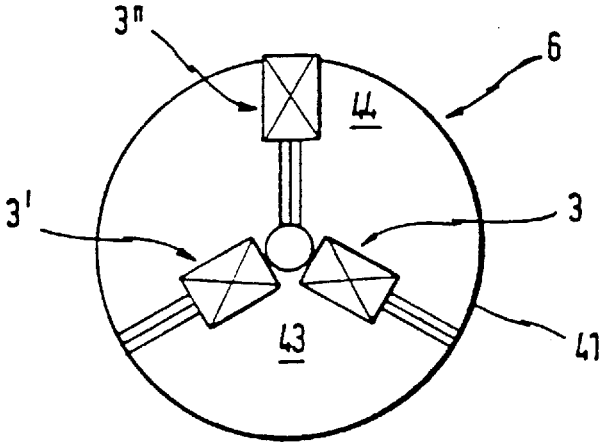

In the following, the apparatus will be explained in more detail with reference to the embodiments shown. There are shown:

FIG. 1 a general drawing of the apparatus for removing a stack in the working position directly at the stacking station, FIG. 2 a view of the apparatus for removal seen in the direction of the arrow II in FIG. 1, with both gripper devices being shown, FIG. 3 a view of a gripper unit from the direction of the arrow III in FIG. 1 directly after the grasping of a stack, FIGS. 4*a* to *c* respective detail representations of a carriage guide arrangement and also of a drive arrangement of a gripper unit, FIG. 5 a schematic illustration of a wave-stabilisation by multiple bar arrangements, FIG. 6 a schematic illustration of an apparatus for moving beneath, and FIG. 7 a schematic illustration of a rotary table formed as a carousel with more than two gripper devices.

In FIG. 1 there is shown an apparatus 1 for removing a stack 12 from a collection point or position 2 in a stacking device.

The apparatus has two gripper devices 3, 3' of which only the device 3 is shown in FIG. 1. The gripper device 3 is illustrated in continuous lines in the position in front of the collection point with the stack 12 having been grasped and, in broken lines, in the position in which it has been moved into the collection point 2, with the collection point 2 also being shown in broken lines.

The gripper device consists of an upper and a lower gripper unit 4 or 5 respectively, with the upper gripper unit 8 being upwardly and downwardly movable in the illustrated embodiment by means of a piston-in-cylinder device 21, 22. This vertical path of the upper gripper unit 4 is controlled by a sensor 20 and the sensor can be any desired sensor with suitable characteristics which can react to proximity. In the illustrated embodiment the sensor is a pneumatic sensor.

The lower gripper device 5 travels on the stacking table into corresponding grooves 37 which are formed in an apparatus 13 for moving beneath. The apparatus 13 for moving beneath is arranged in a suitable manner on the stacking table 11.

As can be seen in particular in FIGS. 2 and 4, the gripper devices 3, 4 are arranged on a carriage 7 which can be moved forward and back in a horizontal carriage guide 8 of a rotary table 6. Further details will be explained in more detail further below. The upper gripper unit 4 is upwardly and downwardly movable on its own carriage guide 10. The carriage guide 10 is arranged in a gripper frame 9 which is movable forwardly and backwardly on the carriage 7.

The upper and the lower gripper units 4 and 5 respectively can be made adjustable with respect to the gripper length a. This adjustment is necessary in order to be able to always ideally grasp different printed products.

The lower gripper unit 5 consists, as can be seen from FIG. 3, of a bar arrangement 14 with two bars 15 and 15' arranged in a holder 38. These bars are of adjustable length in the holder 38.

The spacing of the two bars 15, 15' is so selected that each stack of printed products hangs down in a concave channel-like manner between two support lines formed by the bars. These hanging down portions are aided by the upper gripper unit 4 which has a shaped part 16. The shaped part 16 is convexly bent downwardly, so that the upper region of a stack 12 forms a stack channel 17. The shaped part 16 is mounted on a bar arrangement 18 which is adjustably held on the vertical carriage.

The arching 19 of the shaped part 16 can clearly be seen in the plane of the drawing of FIG. 3. The length of the shaped part which assists the formation of the channel extending in the removal direction is approximately so dimensioned that it extends about halfway along the stack. The gripper units 4, 5, however, only travel so far above and below the stack respectively that a region remains free which is required for the banding of the stack.

The vertical carriage guide arrangement 10 co-operates with a lifting plate 23 formed as a carriage. The carriage guide arrangement 10 consists in this. arrangement of cylinder-like guide bars 21, 22 which are surrounded by corresponding ball bushings 21', 22'. These ball bushings which serve for guidance are secured in the customary manner to the lifting plate 23.

The lifting plate or the carriage 23 is connected to a piston rod 24 of a piston-in-cylinder arrangement 25 which is held on the gripper frame. The gripper frame 9 is mounted on the rotary table 6 on a base plate 28 formed as a carriage. The movement of the carriage 7 having the base plate 28 is brought about by a linear drive. This linear drive can, on the one hand, be a toothed belt drive, however, the overall arrangement can also be formed as a linear motor arrangement. Finally, a propelling movement is also possible by means of a spindle drive or a hydraulically pneumatically acting piston-in-cylinder arrangement.

The rotary table 6 has a base plate 30 on which or at which the linear drive is arranged, optionally with the drive motor 31. The base plate 30 is in turn arranged on a table carrier 32. In the illustrated embodiment, the table carrier 32 is of tubular design and has a bearing ring arrangement 33 in the lower region which co-operates via a drive 34 with a motor for the purpose of rotation of the table carrier and thus of the whole rotary table 6.

A gear transmission or also a toothed belt transmission or any other form of pivotal transmission can be provided as the drive.

The lower counterpiece to the bearing ring arrangement 33 is provided on a frame 36 of fixed position which also carries the motor for the rotation of the table.

Both gripper devices 3, 3' are arranged on the base plate 30, with these two gripper devices operating alternately. As can be seen from FIG. 2 in particular, the two gripper devices are respectively arranged parallel to one another in the opposite direction. Thus, when the gripper device 3 is directed towards the stacking station, the gripper device 3' in contrast faces the next treatment station.

In FIG. 5 there is shown a schematic representation of a stabilisation by a multiple wave. With a stabilisation of this kind, the shaped part of the upper gripper unit consists of the bars 18, 18', whereas the lower gripper unit has a bar arrangement of three individual bars 15, 15', 15". The bars of the upper gripper unit are thereby so arranged that they lie essentially accurately in the immediate space between the bars 15, 15' and 15' and 15" respectively. Through this arrangement, a uniform wave is formed in the stack of products.

A stabilisation by means of the above described wave is particularly favourable for printed products which are readily capable of sliding, but which can simultaneously not be piled up to a large stack height. It can, however, also be advantageous when the bars 18, 18' of the upper gripper unit do not project precisely centrally into the free space between the lower bars 15, 15' and 15' and 15" respectively. An improved clamping action can be achieved for certain products when the bars 18, 18' are moved closer to the outer bars 15 and 15" of the lower gripper unit.

In FIG. 6 there is shown a schematic illustration of an apparatus for engaging beneath, such as can be realised when using a lifting plate in the stacker. The lifting plate thereby rotates jointly with the rotary table of the stacking station in order to receive the stacks in mutually displaced positions. Respective oppositely disposed grooves 40 are formed in the lifting plate into which the bars 15, 15' and optionally 15" can move so that they grasp the stack collected on the lifting plate 40 beneath the stack.

FIG. 7 shows a schematic illustration of a rotary table 6 formed as a carousel with three gripper devices 3, 3' and 3". The carriage guides of these gripper devices are arranged in star-like manner relative to one another, with the path of movement of each gripper device extending from a waiting position 43 in the center of the rotary table 6 up to a working position 44 at the outer periphery of the rotary table.

In the following, the method of the invention, and in this connection also the manner of operation of the above described apparatus, will be explained in more detail.

When an adequate number of stacked products have been collected into a stack at the collection point 2, the gripper device 3 (first gripper device) travels in the open state, i.e. with the upper gripper unit moved upwardly, into the collection point. The gripper units are of adjustable length in such a way that they leave a winding region 27 free at the center of the stack.

The control for the gripper device is acted on through an end switch 39 at the end of the carriage guide 8 in such a way that the upper gripper unit 4 is moved downwardly. As soon as the sensor 20 at the end of the shaped part 16 has reached the triggering proximity above the stack, the upper gripper unit is controlled by means of a corresponding signal, so that the shaped part 16 is pressed into the stack. At the same time, the stacking table 11 is lowered so that the stack 12 now comes to lie on the bars 15, 15' of the lower gripper unit 5. As a consequence of its own weight, and also as a result of the pressure of the shaped part 16 of the upper gripper unit 4, the stack 12 is now given a channel-like configuration, i.e. the central region is indented and the side regions pressed upwardly, so that the central region between the lower bars 15 and 15' is bent downwardly to a greater or lesser degree depending on the type of product. The stack is stabilised by this channel-like shape and it can now be removed from the collection point 2 by backward movement of the carriage 7 out of the collection point without the danger of it falling apart. After the stack has left the collection point 2, the rotary table is rotated via a signal generator 39' at the rear end of the carriage guide 8 through the desired number of degrees. In the present embodiment a rotation through 180° is assumed. After the rotation, the first gripper device 4 is located so to say with its back to the collection point 2 and is moved after the rotation in accordance with the control program, again with the aid of the carriage device forwardly to a further processing or treatment station disposed opposite to the collection point. After reaching the corresponding issuing position, a corresponding signal is triggered in accordance with the setting of the signal generator.

The gripper unit then opens, whereby the stack is deposited at the desired position. During the rotation and the handover procedure the collection point has again filled with a new stack 12 which is grasped in the described manner by the second gripper device and is moved out of the collection point 2. During this removal procedure the first gripper device moves back again, so that it is again located in the starting position after a return rotation of the rotary table 6, in which it is ready to travel into the collection point again.

In the case of using a rotary table with a plurality of gripper devices, a sequence of events similar to the above described manner of operation takes place. As soon as a gripper device, for example the gripper device 3', has grasped a stack in the stacking station it travels back into its waiting position 43. Thereafter, the rotary table is rotated through 120° and the adjacent empty gripper device is moved out of the waiting position 43 into the working position 44. In the time in which this gripper device grasps the next stack from the stacking station, the gripper device 3" moves out of its waiting position into the working position again and hands over the stack to a further processing station. Thereafter, it either travels back empty into its waiting position or it can supply the stack to a third station in which a further processing procedure takes place. If the requirement exists, a carousel with more than two gripper devices can also be provided.

The described apparatus, and also the method which has been explained are not tied or restricted to the described and illustrated embodiments. Thus, the gripper device can be so formed with respect to the lower gripper unit that it lifts the stack 12 somewhat after moving into the collection point 2 and removes it from the collection point 2 without the stacking table 11 having to be lowered. In this manner it is not necessary to interfere in the control procedure for the collection point, one can in such a case embody the presence of the gripper device in the collection point into the sequence of the stacking program via corresponding signal generators.

The carriage arrangements of both the horizontal and also the vertical carriage are also not necessarily tied to the described embodiments for the manner of operation and the inventive functioning of the apparatus. If, for example, a linear motor is used, then embodiments other than those described can be more sensible. An opening and a closing movement of the gripper units by means of an eccentric drive is also conceivable, with the eccentric drive being actuated via a corresponding piston-in-cylinder arrangement.

I claim:

1. Apparatus for handling a stack of sheet-like products, the apparatus comprising:

a rotary table having a central axis of rotation extending vertically therethrough on which at least two gripper devices are arranged which each have an upper gripper unit and a lower gripper unit vertically below the upper gripper unit ; and a carriage for each gripper device and an associated linear horizontal carriage guide of the rotary table for supporting the carriages for linear movement therealong for shifting of the devices in a linear direction that is transverse to the table axis forwardly and backwardly for linearly sliding the lower gripper unit under the product stack for supporting the stack for linear movement with the device supported by the units thereof, and for linearly sliding the lower gripper unit out from under the stack so that the stack is not supported by the units.

2. Apparatus in accordance with claim 1, wherein the upper gripper unit is movable upwardly and downwardly.

3. Apparatus in accordance with claim 2, wherein each gripper device has at least one carriage guide on which the upper gripper unit can be moved upwardly and downwardly.

4. Apparatus in accordance with claim 1, wherein at least one of the upper and lower gripper units has at least two bars arranged at a spacing from one another.

5. Apparatus in accordance with claim 1, wherein the upper gripper unit has a downwardly arched shaped part for engaging products in a stack.

6. Apparatus in accordance with claim 5, wherein the shaped part is mounted on a bar arrangement.

7. Apparatus in accordance with claim 5, wherein a sensor is arranged in the shaped part of restricting the path of the upper gripper unit.

8. Apparatus in accordance with claim 1, wherein two gripper devices are arranged in parallel and respectively oppositely directed.

9. Apparatus in accordance with claim 1, wherein the rotary table has an outer periphery and three or more gripper devices are arranged on the rotary table and are movable from a waiting position into a working position located at the outer periphery of the rotary table.

10. Apparatus in accordance with claim 9, wherein the waiting position is located in the region of the center of the rotary table and a working position is located at its outer periphery.

11. Apparatus in accordance with claim 10 wherein the gripper devices each have an opening defined between the upper and lower gripper units thereof which face in a direction away from the rotary table axis when the devices are in the working position.

12. An apparatus for handling a stack of sheet-like products, the apparatus comprising:

a rotary table for rotation about a vertical axis extending therethrough and the table having an outer periphery thereof;

a gripper device mounted for linear shifting generally between the outer periphery of the rotary table and a predetermined position relative to the table within the outer periphery thereof;

a linear drive for shifting the device in a linear direction transverse to the rotary axis between a waiting position and a working position; and upper and lower gripping units of the device for supporting the product stack therebetween with the units being shifted in the linear direction as the drive shifts the device linearly to slide the lower unit either under or out from under the product stack as the device moves between the waiting position and the working position without pivoting or swiveling of the lower unit.

* * * * *